US009725214B2

(12) United States Patent
Crosby

(10) Patent No.: US 9,725,214 B2
(45) Date of Patent: Aug. 8, 2017

(54) CONTAINER LID WITH INTEGRAL LID HOLDER

(71) Applicant: William Crosby, Vero Beach, FL (US)

(72) Inventor: William Crosby, Vero Beach, FL (US)

(73) Assignee: Crosby Unlimited, L.L.C., Vero Beach, FL (US)

( * ) Notice: Subject to any disclaimer, the term of this patent is extended or adjusted under 35 U.S.C. 154(b) by 0 days.

(21) Appl. No.: 13/801,131

(22) Filed: Mar. 13, 2013

(65) Prior Publication Data

US 2013/0320018 A1 Dec. 5, 2013

Related U.S. Application Data

(60) Provisional application No. 61/652,930, filed on May 30, 2012.

(51) Int. Cl.

| | |
|---|---|
| ***B65D 51/24*** | (2006.01) |
| ***B65D 41/18*** | (2006.01) |
| ***B65D 43/02*** | (2006.01) |
| ***B65D 55/16*** | (2006.01) |

(52) U.S. Cl.

CPC ..... *B65D 41/18* (2013.01); *B65D 43/0212* (2013.01); *B65D 55/16* (2013.01); *B65D 2543/00046* (2013.01); *B65D 2543/00092* (2013.01); *B65D 2543/00296* (2013.01); *B65D 2543/00351* (2013.01); *B65D 2543/00509* (2013.01); *B65D 2543/00555* (2013.01); *B65D 2543/00629* (2013.01); *B65D 2543/00685* (2013.01); *B65D 2543/00731* (2013.01); *B65D 2543/00796* (2013.01)

(58) Field of Classification Search

CPC .... B65D 41/18; B65D 43/0212; B65D 55/16; B65D 2543/00685; B65D 2543/00296; B65D 2543/00509; B65D 2543/00796; B65D 2543/00046; B65D 2543/00555; B65D 2543/00351; B65D 2543/00629; B65D 2543/00092

USPC ..... 220/744, 212, 784, 799, 713, 521, 780, 220/793; 229/404, 906.1

See application file for complete search history.

(56) References Cited

U.S. PATENT DOCUMENTS

| | | | | |
|---|---|---|---|---|
| 4,127,211 A | | 11/1978 | Zerbey | |
| 4,589,569 A | * | 5/1986 | Clements | 220/380 |
| 4,872,577 A | | 10/1989 | Smith | |
| 5,050,759 A | | 9/1991 | Marble | |

(Continued)

OTHER PUBLICATIONS

Coffee Top Caddy, Josh Harris Spring, 2008.

*Primary Examiner* — James N Smalley
(74) *Attorney, Agent, or Firm* — Stephen C. Thomas

(57) ABSTRACT

An improved container lid comprising an integral lid retaining channel which is configured to accept and be press fit onto the circumferential rim of a container, such as, for instance, a coffee cup is disclosed in preferred and various alternate embodiments. The improved container lid of the invention may comprise any material suitable for container lids such as paper, waxed paper, plastic, or other materials known in the art. The improved container lid of the invention is adapted to be retained upon, for example, a lip of a beverage container while the beverage container is in use. Thus, the improved container lid of the invention prevents accidental loss of the container lid and may be used in an open or closed position.

15 Claims, 20 Drawing Sheets

(56) References Cited

U.S. PATENT DOCUMENTS

| | | | | |
|---|---|---|---|---|
| 5,102,002 | A | 4/1992 | Whitley | |
| 5,148,937 | A | 9/1992 | Huard | |
| 5,244,106 | A | 9/1993 | Takacs | |
| D379,928 | S | 6/1997 | Freek et al. | |
| 5,765,716 | A | 6/1998 | Cia et al. | |
| 5,868,268 | A | 2/1999 | Walker | |
| 6,047,852 | A | 4/2000 | Evans et al. | |
| 6,131,755 | A | 10/2000 | Soyka, Jr. et al. | |
| 6,318,584 | B1 * | 11/2001 | Milan | 220/713 |
| 6,343,735 | B1 | 2/2002 | Cai | |
| 6,923,338 | B2 * | 8/2005 | Dees et al. | 220/793 |
| 7,156,253 | B2 | 1/2007 | Ziegler | |
| 7,175,043 | B2 | 2/2007 | O'Neal | |
| 7,398,892 | B2 | 7/2008 | Bouie | |
| 7,673,767 | B2 * | 3/2010 | Vovan | 220/212 |
| 7,870,968 | B2 | 1/2011 | Hanson | |
| 2001/0050283 | A1 | 12/2001 | Nance | |
| 2005/0173434 | A1 * | 8/2005 | O'Neal | 220/212 |
| 2007/0051738 | A1 | 3/2007 | Slayton | |
| 2010/0012657 | A1 | 1/2010 | Levey | |

* cited by examiner

CONTAINER LID WITH INTEGRAL LID HOLDER

CROSS REFERENCE TO RELATED APPLICATIONS

This non-provisional patent application is respectfully filed with the United States Patent and Trademark Office claiming the benefit of U.S. Provisional Application Ser. No. 61/652,930, filed in the USPTO on May 30, 2012, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention relates generally to the field of containers with lids, specifically, lids adapted to be removably attached to containers. One example of such a container is a beverage cup, such as beverage cups fabricated from plastic or Styrofoam which are typically used to hold a flowable substance such as hot coffee or the like and which are adapted to receive removably attached lids that are press fit onto the rim of a cup. Other examples of such containers include, milk jugs with threadingly attached lids, pill bottles with tamper-proof removably attached lids, laundry detergent bottles, paint cans and any other container that is adapted to receive a removably attached lid. More specifically, in one embodiment, the invention relates to an improved beverage cup lid which is adapted to mount onto the rim of a beverage container in an open position by removably attaching a lid retaining channel disposed in the top of the lid to a rim of the beverage container. The container lid of the present invention allows a user to removably attach the lid to the rim of a container in an open position, so that, in the example of the beverage cup, condiments can be added to a contained beverage or a beverage can be consumed while the lid is removably attached to the cup in an open position, thus allowing the lid to be retained for further use.

2. Background Art

Containers, which include but are not limited to beverage containers, such as disposable coffee cups, iced drink cups, milk jugs, pill bottles, salt and pepper shakers, dispensing containers, such as those used to dispense sugar or flour, and other containers having removably attached lids have been marketed and used for many years. The containers of the prior art may be typically constructed of an inexpensive material such as Styrofoam®, plastic such as, for example, Polyethylene Terephthalate (PET) plastic, paper, or some other light weight material suitable for containing a substance. Recently, certain recyclable and biodegradable materials have been selected for use, for example, in beverage and other containers. Such biodegradable plastics are typically derived from renewable sources such as starch and vegetable oil and can be decomposed into water, carbon dioxide and non-toxic compounds at the end of their life stage, and, as such, are engineered to be broken down by enzyme producing organisms. Biodegradable containers are increasing in usage as environmental concerns grow over time.

Typically, containers are also supplied with removable lids that are designed to removably attach to a rim of the container by, for example, a press fit onto the rim of the container, or, alternatively the lid may threadingly engage with the container rim in order to keep a contained substance, which may be a flowable substance such as for example a beverage, detergent, or any other flowable substance from splashing out of the container and, in the case of a hot beverage example, to keep the beverage from rapidly reducing temperature due to heat transfer from the hot beverage to the atmosphere. In the more general sense, the same desire is present for containers that contain other flowable substances or non-flowable substances such as, for example, sugar, flour, spices, pills contained in a pill bottle, liquids, discrete items such as small fasteners, coins or any other items stored in a container. It is therefore usually desired that a container also be supplied with a lid to prevent spillage, thermal loss as in the coffee example, contamination, and the like.

However, the container lids of the prior art are prone to becoming lost or accidentally discarded when removed from the container by the user. The lid may be removed by the user, for instance, when the user desires to add condiments such as creamer, ice, sugar or other sweetener, or any other product the user desires, to a beverage contained in a beverage container. The container lids of the prior art are usually light weight and therefore may be blown away from the user by the wind, causing loss of the lid. The result of the loss of the container lid, in this example, is that the beverage is no longer effectively prevented from splashing out of the container, and furthermore, if the beverage is a hot beverage such as, for example, coffee or hot cocoa, it will cool much more rapidly than if a lid were utilized, and may therefore become unacceptable for consumption by the user. This same limitation holds true for other containers of the prior art such as, for example, milk jugs, pill bottles, reusable food storage containers, and the like.

What is needed therefore is a container lid that is adapted to attach to a typical container in an open position such that the lid is not lost or accidentally discarded while the container is being accessed by the user and is therefore retained for further use as desired by the user.

The apparatus of the container lid of the invention is adapted to meet this existing need in the prior art by the novel features described and claimed herein.

BRIEF SUMMARY OF THE INVENTION

The present invention comprises a system and/or method that has one or more of the following features and/or steps which, alone or in any combination, may comprise patentable subject matter.

In accordance with one embodiment of the present invention, the invention comprises a container lid comprised of features that allow the lid to be removably attached to the rim of a container in an open position, allowing a user to access the contents of the container, such as, for example, when a user desires to provide sugar or creamer to a coffee beverage. Specific features are included in the lid of the invention that form a cup container lid retaining channel, which allows the cup lid of the invention to be removably attached to a rim of a beverage container when a user presses the cup lid retaining channel onto a rim of a beverage container. The cup lid of the invention is comprised of numerous alternate embodiments for forming the cup lid retaining channel which are discussed below and include equivalent structures known to those of ordinary skill in the mechanical arts.

The cup lid of the invention may be left removably attached to a cup in the open position as long as the user desires. When it is desired install it on a cup in the closed position, the user may remove the cup lid from the cup rim, and then may orient the cup lid of the invention in an orientation wherein the bottom of the cup lid is substantially planar with the cup rim, whereupon the user may press the cup lid of the invention onto the cup rim, causing the cup lid of the invention to be removably attached on the cup rim by a press fit that is realized between the cup rim accepting channel and the cup rim. In this manner, the cup lid of the invention is removably attached to a cup rim, preventing spillage of any flowable substance contained inside the cup, preventing change of temperature of the flowable substance, and other desirable advantages, such as, for instance, keeping outside contaminants from contacting the flowable substance. The container lid of the present invention may also be utilized to drink from a container containing a beverage when the lid is installed on a beverage container in either an open or a closed position.

The use of the improved container lid of the invention results in less likelihood that the lid will be lost, which provides many benefits such as, reduction in heat loss due to loss of a contained flowable substance, fewer spills of a flowable substance, less probability of a slip and fall injury due to spilled flowable substances, reduced napkin use, reduced interference with other activities such as driving, and happier consumers.

The present invention may be adapted to be utilized on any kind of container, regardless of the structure used to attach the lid to the container in a closed position.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following documentation provides a detailed description of the invention. While a preferred embodiment and several alternate embodiments are shown, it is to be understood that equivalent structures are within the scope the claims.

Figure 1A:
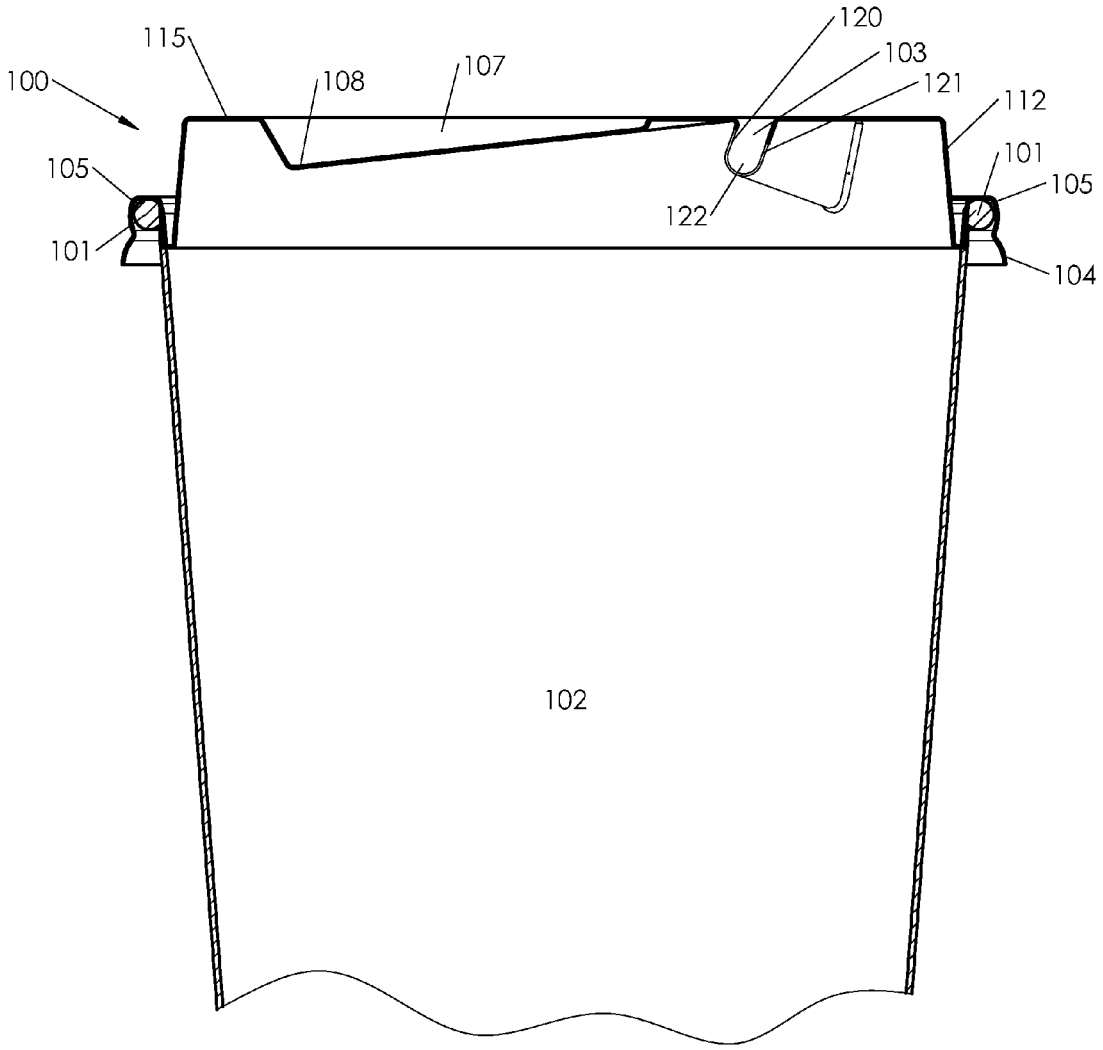
FIG. 1*a* depicts a side view of a preferred embodiment of the invention showing the improved container lid removably attached to a container in a closed position.
Figure 1B:
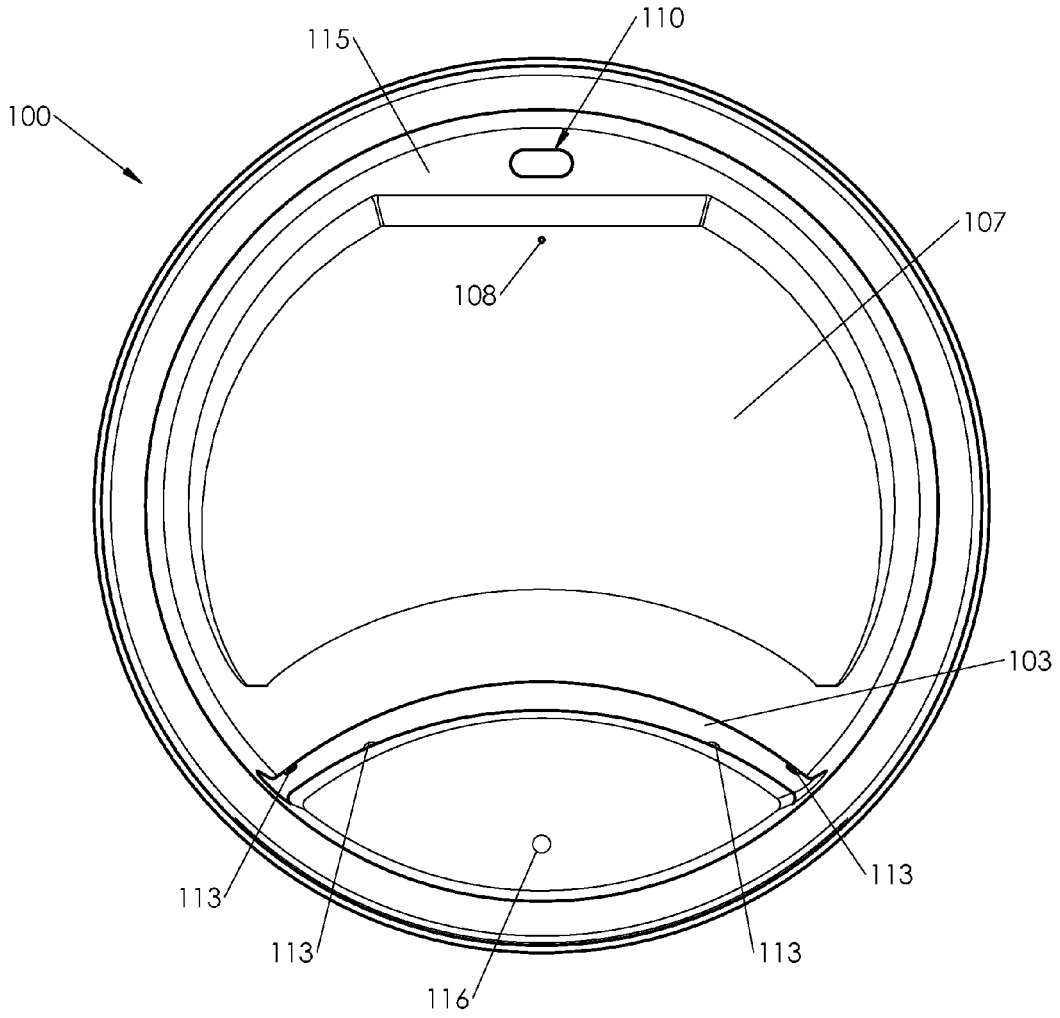
FIG. 1*b* depicts a top view of a preferred embodiment of the invention, with the improved container lid removably attached to a container in a closed position.
Figure 1C:
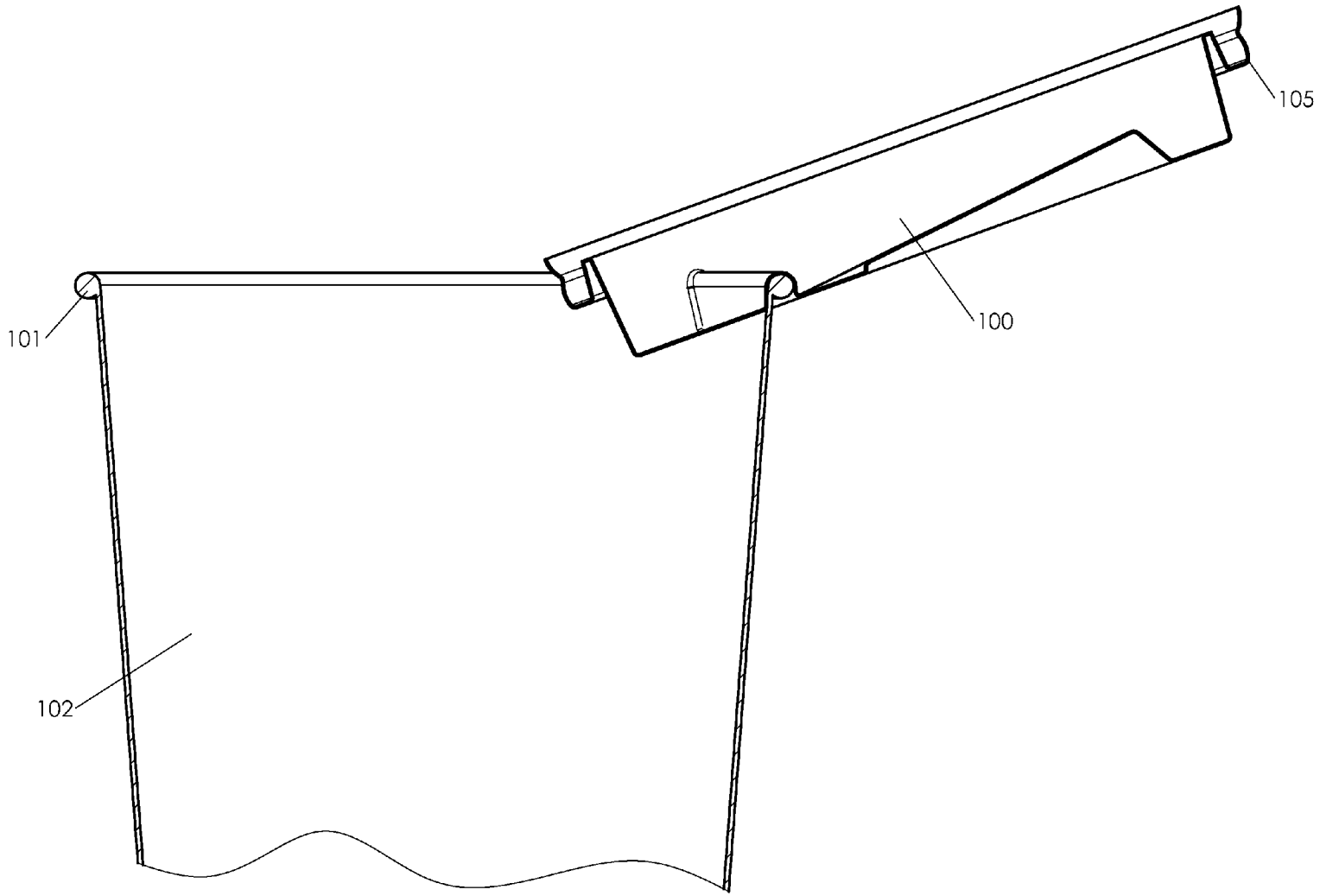
FIG. 1*c* depicts a side view of a preferred embodiment of the invention with the improved container lid removed from the closed position and removably attached in an open position to a container.

Referring now to FIGS. 1*a*, 1*b* and 1*c*, a preferred embodiment of the improved container lid 100 is depicted installed on a container 102. FIG. 1*a* depicts container lid 100 removably attached to container 102 in a closed position. Container 102 may be, for example, a typical beverage container which is designed to hold beverages of any type, and may therefore hold hot beverages such as, coffee or hot cocoa. However, any substance, including flowable and non-flowable substances, may be contained in container 102. Container 102 further comprises a container rim 101 extending around the periphery of container 102. It should be noted that although container 102 is shown as substantially circular in cross section, and thus container lid 100 is also substantially circular in configuration as viewed from the top in FIG. 1*b*, container 102 cross sectional shape and improved container lid 100 shape may be any shape such as elliptical, rectangular, square or any other shape.

Referring now to FIG. 1*a*, the improved container lid of the invention 100 is installed upon container rim 101 in a closed position by holding improved container lid 100 over container rim 101 such that the plane created by the circumference of bottom periphery flange 104 is substantially coplanar with the plane established by container rim 101, and pressing the improved container lid of the invention 101 downward, such that bottom periphery flange 104 guides improved container lid 100 into place, such that container rim accepting channel 105 engages container rim 101 in a press fit, which removably attaches improved container lid 100 in place using a press fit in a closed position as shown in FIG. 1*a*, and preventing flowable substances such as beverages or other liquids, or non-flowable substances such as discrete objects, from spilling out of container 102, and, in the example in which the contained substance is a beverage, also serves to enable such beverage contained within container 102 to maintain temperature.

Still referring to FIG. 1*a*, a preferred embodiment of the improved container lid of the invention 100 is shown as comprising a lid retaining channel 103 that has a first wall 120, a second wall 121, and a bottom 122 which together form a contiguous surface with annular side wall 112 and lid top surface 115 such as to form, except for aperture 110, drain hole 108 and vent hole 116, a contiguous surface for improved container lid 100 such that a flowable substance is substantially prevented from spilling out of the container when improved container lid 100 is installed in the closed position as shown in FIG. 1*a*. In the preferred embodiment shown, lid retaining channel 103 is dimensioned to accept container rim 101 when improved container lid 100 is pressed into place in the open position depicted in FIG. 1*c*.

Referring now to FIG. 1*b*, a top view of a preferred embodiment of the improved container lid of the invention 100 is shown. In the preferred embodiment shown, lid retaining channel 103 is arcurate in shape and is of substantially the same radius as the periphery of container rim 101, which, in the embodiment shown in FIG. 1*b*, is substantially circular. However, it should be noted that the periphery of container rim 101 may be any cross sectional shape including but not limited to circular as shown in the figure, elliptical, square, rectangular or any other shape. Lid retaining channel 103 is shaped to fit the container with which the lid is intended to match, and therefore takes substantially the same shape as the periphery of container rim 101.

Still referring to FIG. 1*b*, container lid 100 may further comprise well 107 which may have a sloping bottom surface and well drain hole 108. These optional features allow flowable substance to be captured in well 107 and to drain into container 102 through well drain hole 108 which may be disposed at substantially the lowest point of the sloping bottom surface of well 107. Such collection of flowable substance may occur, for instance, when an improved container lid of the invention 100 is installed in a closed position on a container, which is a beverage container, containing a flowable substance which is a beverage. In this example, a user may drink from the container through aperture 110, leaving a small amount of liquid that is not consumed by the user, and which drains into well 107, whereupon it may drain back into container 102 thus preventing unnecessary drippings from collecting on lid top surface 115. Well 107, well drain hole 108, aperture 110 and vent hole 116 are optional elements and need not be present in all embodiments of the invention. Thus, the improved container lid of the invention 100 may include any of these or none of these elements in the various alternate embodiments. Still referring to FIG. 1*b*, optional vent hole 116 allows air to enter container 102 in the event that container 102 is tipped to allow flowable liquid to exit the container through aperture 110. In the preferred embodiment shown in FIGS. 1*a*, 1*b* and 1*c* lid top surface 115 is substantially planar, although in alternate embodiments lid top surface 115 need not be planar, but may be any shape desired.

Still referring to FIG. 1*b*, lid retaining channel 103 may further comprise at least one retaining channel protrusion 113 which protrudes into lid retaining channel 103 to provide a point press fit with container rim 101 when improved container lid 100 is installed on container rim 101 in an open position. Lid retaining channel 103 may comprise any number of retaining channel protrusions 113, or, alternatively, may comprise no retaining channel protrusion 113. A preferred embodiment comprises a plurality of retaining channel protrusions 113.

Referring now to FIG. 1*c*, a side view of a preferred embodiment of the improved container lid of the invention 100 is shown installed on a container in an open position. As shown in FIG. 1*c*, improved container lid 100 is removably attached to container 102 by a press fit engagement between lid retaining channel 103 and container rim 101. In this open position, the contents of container 102 may be accessed by the user. In the example in which container 102 is a beverage container, it can be seen that improved container lid 100 is retained during the period of time when a user is accessing the contents of container 102, which may be, for example, a beverage.

Still referring to FIG. 1*c*, lid retaining channel 103 is configured to accept the container rim 101 in a press fit when it is desired to configure the container lid of the invention on container rim 101 in an open position. When it is desired to return the improved container lid 100 to be re-installed onto container 102 in a closed position, the user simply removes the container lid 100 from the press fit engagement between lid retaining channel 103 and container rim 101 which holds container lid 100 in the open position, and then presses the improved beverage container lid 100 back on to the top of container 102 until container rim accepting channel 105 engages container rim 101 in a press fit.

Figure 2A:
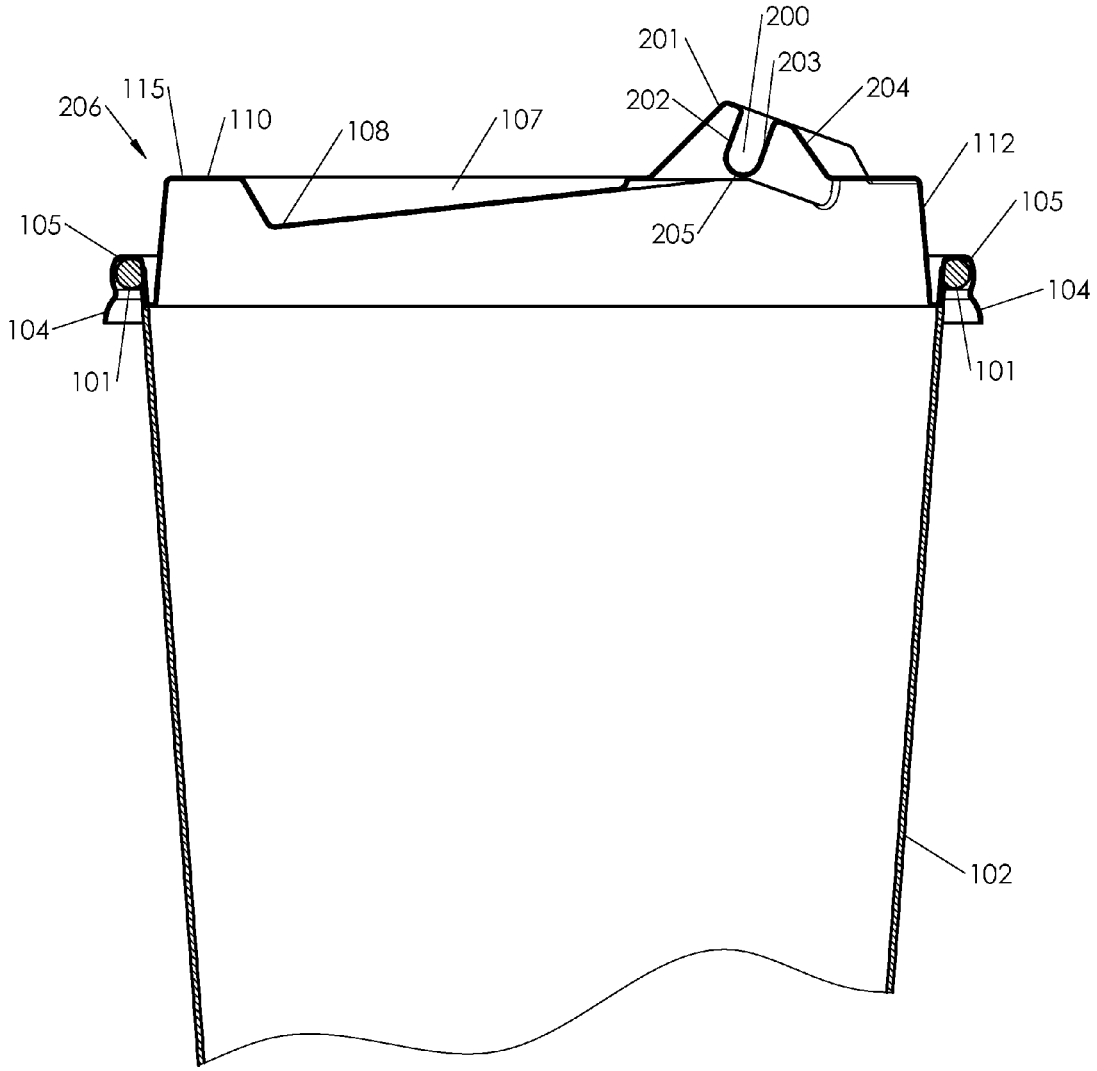
FIG. 2*a* depicts a side view of a first alternate embodiment of the invention showing an improved container lid of the invention removably attached to a container in a closed position.
Figure 2B:
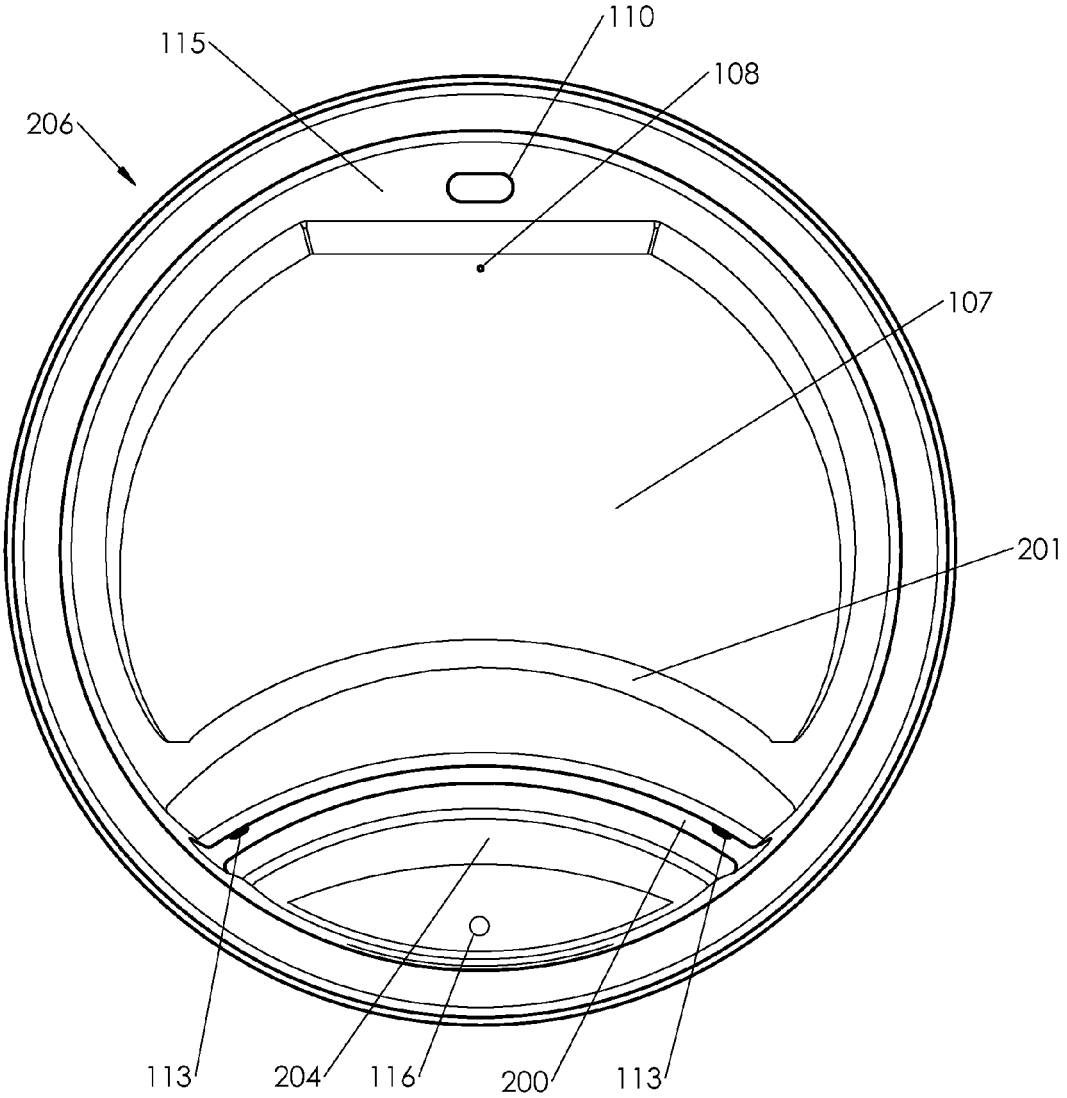
FIG. 2*b* depicts a top view of a first alternate embodiment of the invention, with the improved container lid removably attached to a container in a closed position.
Figure 2C:
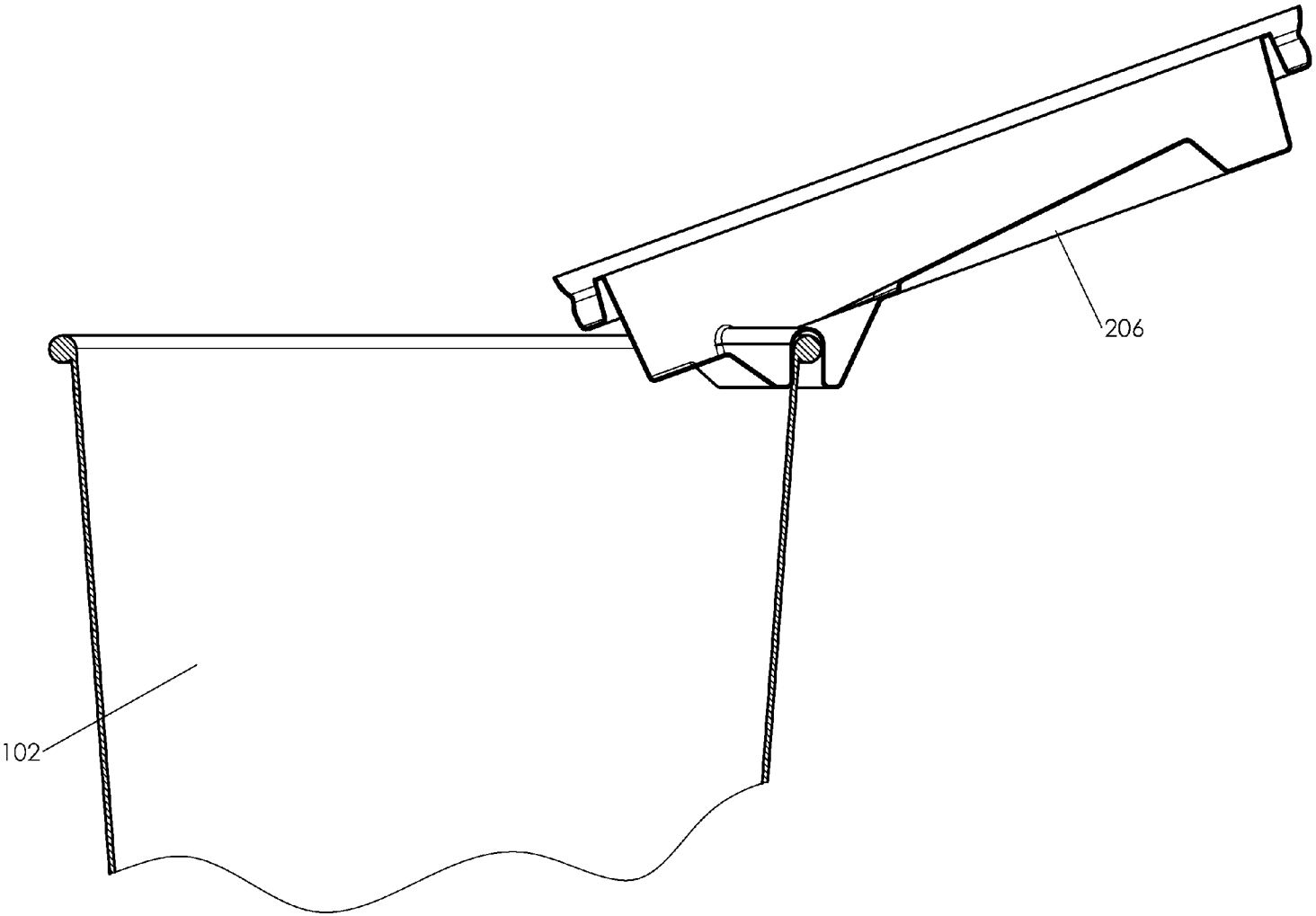
FIG. 2*c* depicts a side view of a first alternate embodiment of the invention, with the improved container lid removably attached to a container in an open position.

Referring now to FIGS. 2*a*, 2*b* and 2*c*, an alternate embodiment of the improved container lid of the invention 100 is depicted in which lid retaining channel 200 is configured as shown as being formed between a first retaining channel protuberance 201 and a second retaining channel protuberance 204. Lid retaining channel 200 comprises a first wall 202, a second wall 203 and a channel bottom 205 which together form a contiguous surface with annular side wall 112 and lid top surface 115 such as to form, except for aperture 110, well drain hole 108 and vent hole 116, a contiguous surface for first alternate embodiment container lid 206 such that a flowable substance is substantially prevented from spilling out of the container when first alternate embodiment container lid 206 is installed in the closed position as shown in FIG. 2*a*. Lid retaining channel 200 is adapted to receive container rim 101 in a press fit when first alternate embodiment container lid 206 is installed on container 102 in an open position. In the first alternate embodiment container lid 206 of the invention depicted in FIGS. 2*a* and 2*b*, lid retaining channel 200 may thus be formed between first retaining channel protuberance 201 and second retaining channel protuberance 204. Lid retaining channel 200 is dimensioned to accept container rim 101 in a press fit when it is desired to utilize the first alternate embodiment container lid 206 in an open position. In this manner, first alternate embodiment container lid 206 is retained during the period of time when first alternate embodiment container lid 206 is installed on container 102 in an open position, such that the lid is not lost or misplaced and thus remains available for further use.

Still referring to FIGS. 2*a* and 2*b*, lid retaining channel 200 may further comprise at least one retaining channel protrusion 113 which protrudes into lid retaining channel 200 to provide a point press fit with container rim 101 when first alternate embodiment container lid 206 is installed on container rim 101 in an open position. Lid retaining channel 200 may comprise any number of retaining channel protrusions 113, or, alternatively, may comprise no retaining channel protrusion 113.

Still referring to FIGS. 2*a* and 2*b*, first alternate embodiment container lid 206 may further comprise well 107 which may have a sloping bottom surface and well drain hole 108. These optional features allow a flowable substance to be captured in well 107 and to drain into container 102 through well drain hole 108 which may be disposed at substantially the lowest point of the sloping bottom surface of well 107. Such collection of flowable substance may occur, for example, when first alternate embodiment container lid 206 is installed in a closed position on a container containing a beverage. In this example, a user may drink from the container through aperture 110, leaving a small amount of liquid that is not consumed by the user, and which drains into well 107, whereupon it may drain back into container 102 through well drain hole 108 thus preventing unnecessary drippings from collecting on lid top surface 115. Well 107, well drain hole 108, aperture 110 and vent hole 116 are optional elements and need not be present in all embodiments of the invention. Thus, the first alternate embodiment container lid 206 may include any of these or none of these these elements in the various alternate embodiments. Still referring to FIGS. 2*a* and 2*b*, optional vent hole 116 allows air to enter container 102 in the event that container 102 is tipped to allow flowable liquid to exit the container through aperture 110. In the first alternate embodiment shown in FIGS. 2*a* and 2*b*, lid top surface 115 is substantially planar, although in further alternate embodiments lid top surface 115 need not be planar, but may be any shape desired.

Figure 3A:
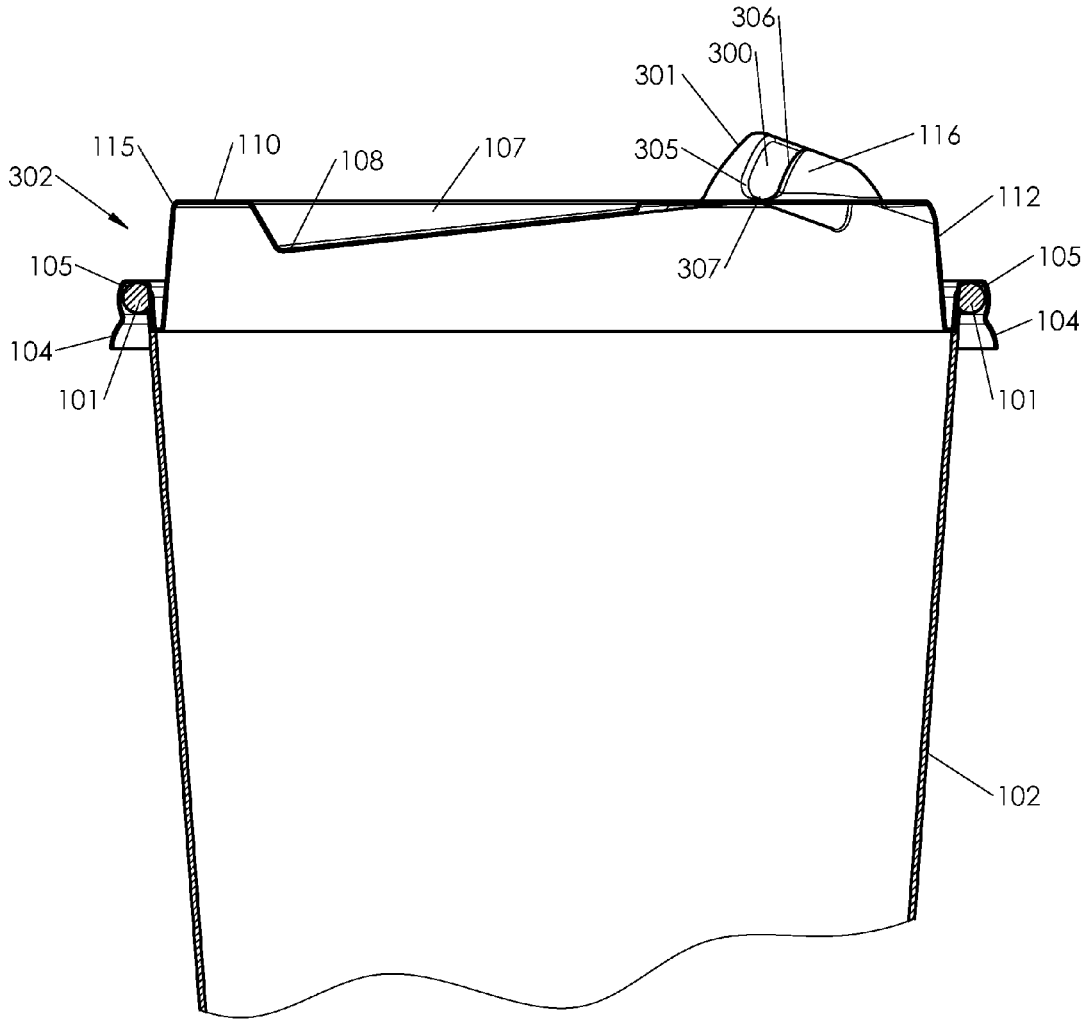
FIG. 3*a* depicts a side view of a second alternate embodiment of the invention showing the improved container lid removably attached to a container in a closed position.
Figure 3B:
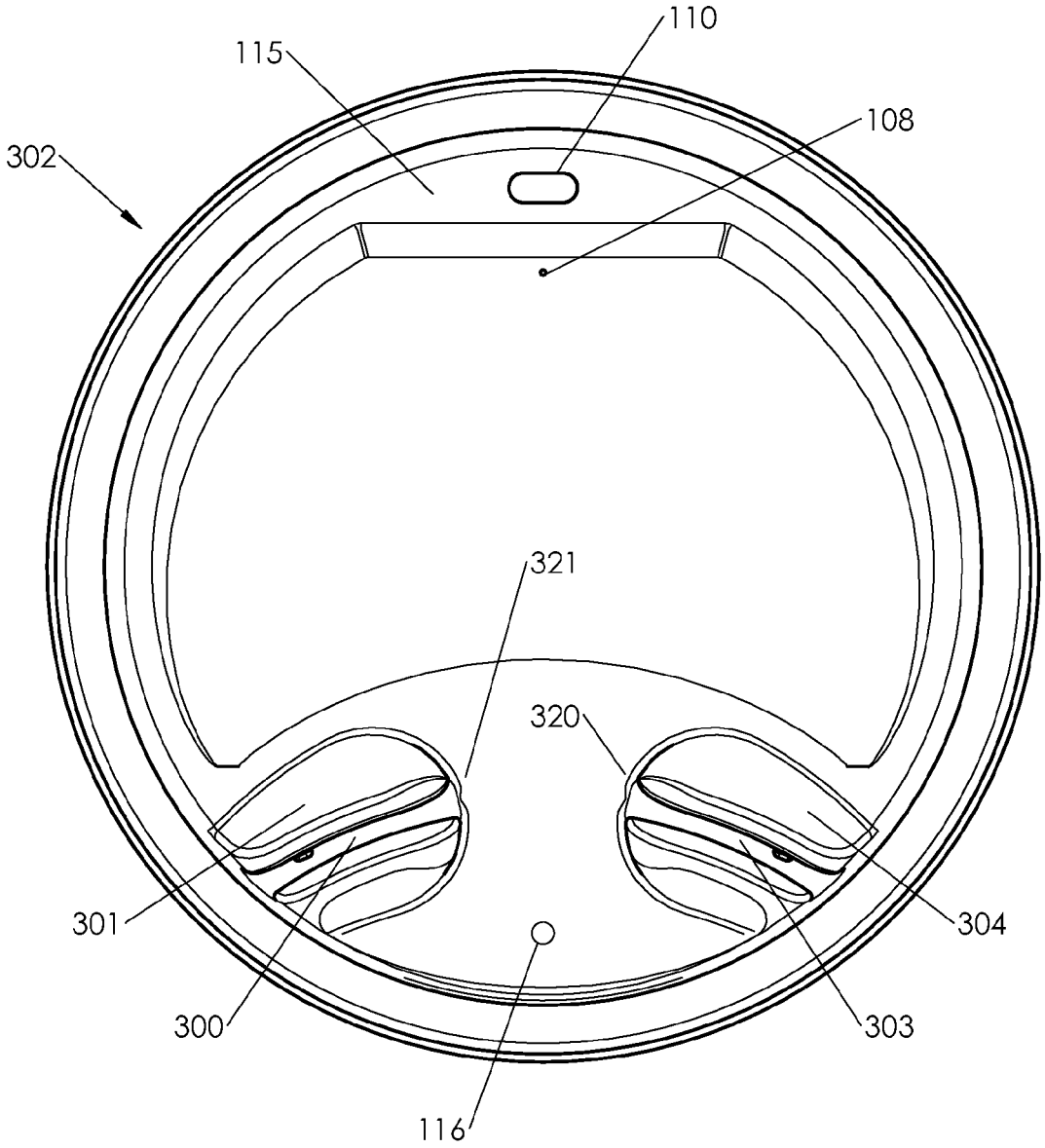
FIG. 3*b* depicts a top view of a second alternate embodiment of the invention showing the improved container lid removably attached to a container in a closed position.
Figure 3C:
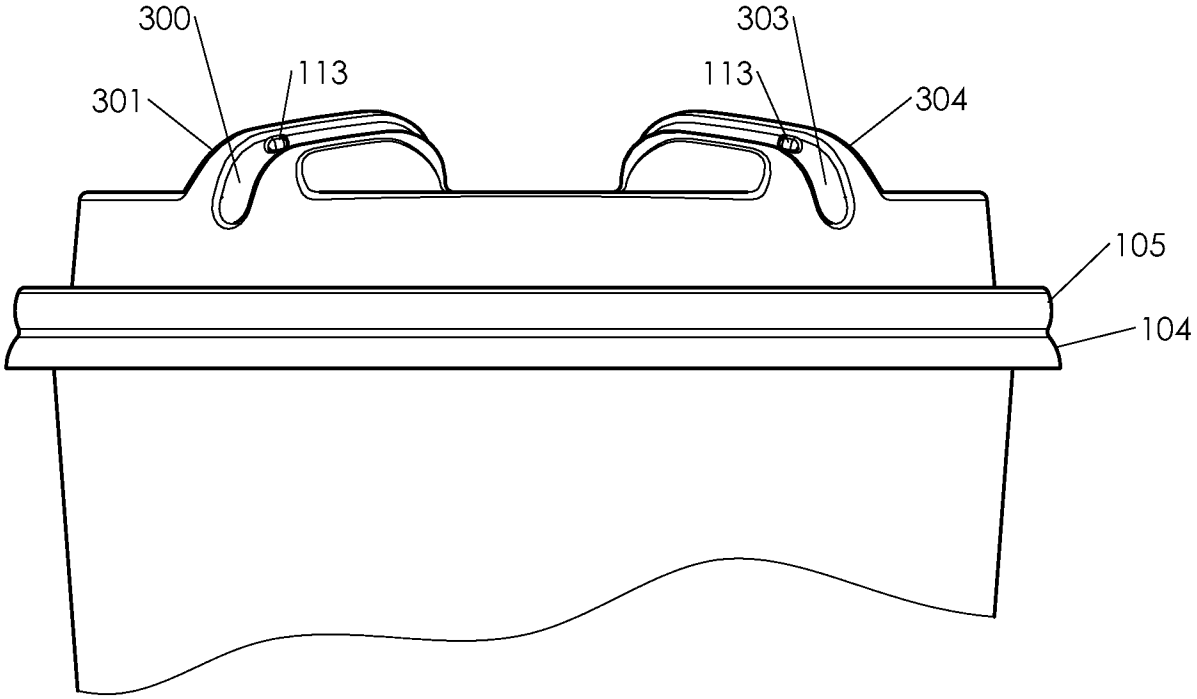
FIG. 3*c* depicts a side view of a second alternate embodiment of the improved container lid of the invention.

Referring now to FIGS. 3*a*, 3*b* and 3*c*, a second alternate embodiment container lid 302 is depicted in which lid retaining channel 300 is formed as a channel in a first mound 301 and a second mound 304. While FIG. 3*b* depicts two mounds, first mound 301 and second mound 304, the invention may comprise any number of mounds. Lid retaining channel 300 may comprise a first wall 305, a second wall 306 and a bottom 307 which together form a contiguous surface with annular side wall 112 and lid top surface 115 such as to form, except for aperture 110, drain hole 108, and vent hole 116, a contiguous surface for second alternate embodiment container lid 302 such that a flowable substance is substantially prevented from spilling out of the container when second alternate embodiment container lid 302 is installed on container 102 in a closed position as shown in FIG. 3*a*. Lid retaining channel 300 is configured to accept the container rim 101 when it is desired to remove the second alternate embodiment container lid 302 of the invention and install it on container 102 for safekeeping. In this manner, the second alternate embodiment container lid 302 is retained during the period of time when the second alternate embodiment container lid 302 is installed on container 102 in an open position.

Referring to FIG. 3*a* second alternate embodiment container lid 302 may further comprise well 107 which may have a sloping bottom surface and well drain hole 108. These optional features allow flowable substance to be captured in well 107 and to drain into container 102 through well drain hole 108 which may be disposed at substantially the lowest point of the sloping bottom surface of well 107. Such collection of flowable substance may occur, for example, when second alternate embodiment container lid 302 is installed in a closed position on a container containing a beverage. In this example, a user may drink from the container through aperture 110, leaving a small amount of liquid that is not consumed by the user, and which drains into well 107, whereupon it may drain back into container 102 through well drain hole 108 thus preventing unnecessary drippings from collecting on lid top surface 115. Well 107, well drain hole 108, aperture 110 and vent hole 116 are optional elements and need not be present in all embodiments of the invention. Thus, second alternate embodiment container lid 302 may include any of these or none of these these elements in the various alternate embodiments. Referring to FIG. 3*b*, optional vent hole 116 allows air to enter container 102 in the event that container 102 is tipped to allow flowable liquid to exit the container through aperture 110. In the preferred embodiment shown in FIG. 3*b*, lid top surface 115 is substantially planar, although in alternate embodiments lid top surface 115 need not be planar, but may be any shape desired.

Still referring to FIGS. 3*a*, 3*b* and 3*c*, lid retaining channel 300 may further comprise at least one retaining channel protrusion 113 which protrudes into lid retaining channel 300 to provide a point press fit with container rim 101 when second alternate embodiment container lid 302 is installed on container rim 101 in an open position. Lid retaining channel 300 may comprise any number of retaining channel protrusions 113, or, alternatively, may comprise no retaining channel protrusion 113.

Figure 4A:
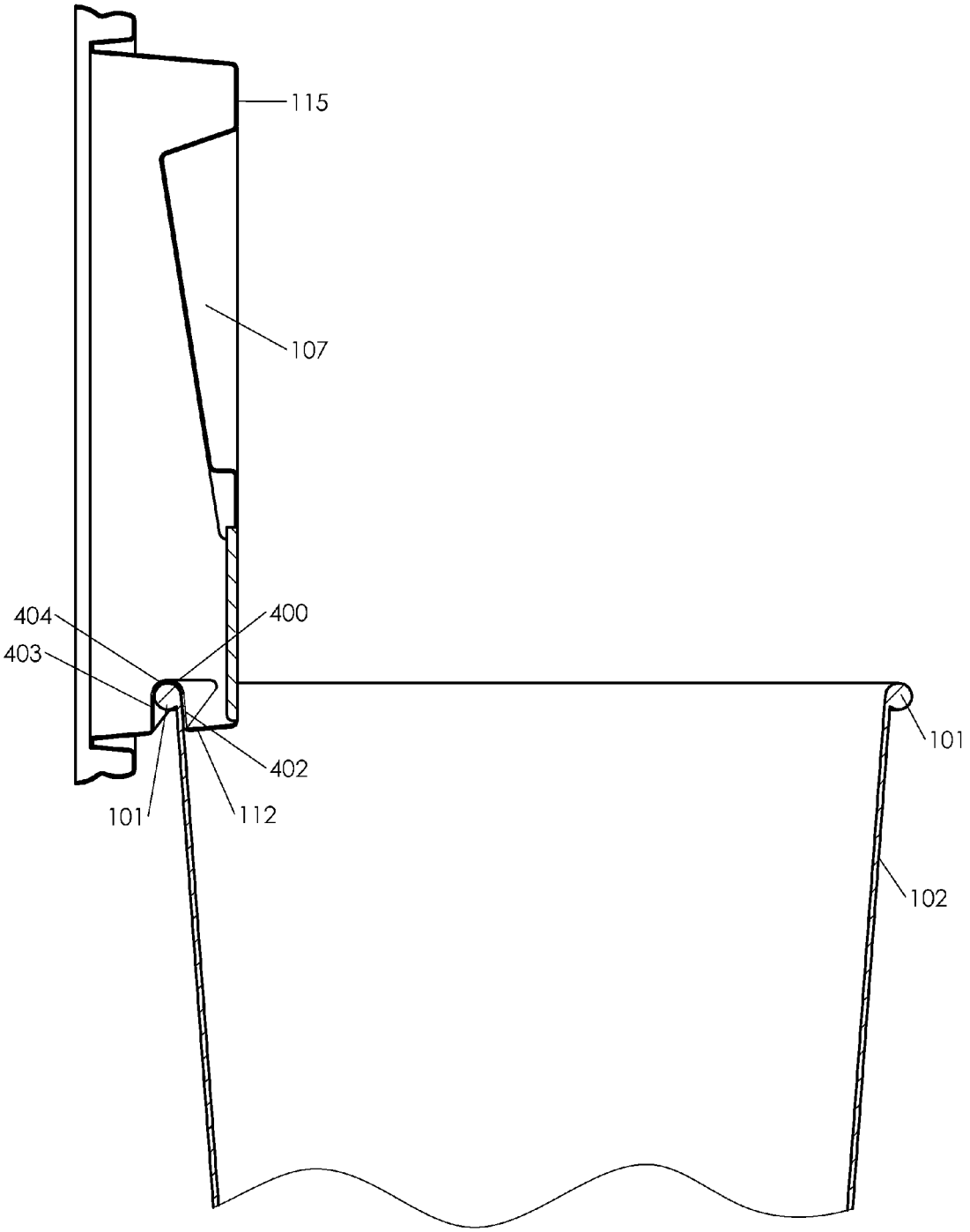
FIG. 4*a* depicts a side view of a third alternate embodiment of the invention showing the improved container lid removably attached to a container in an open position.
Figure 4B:
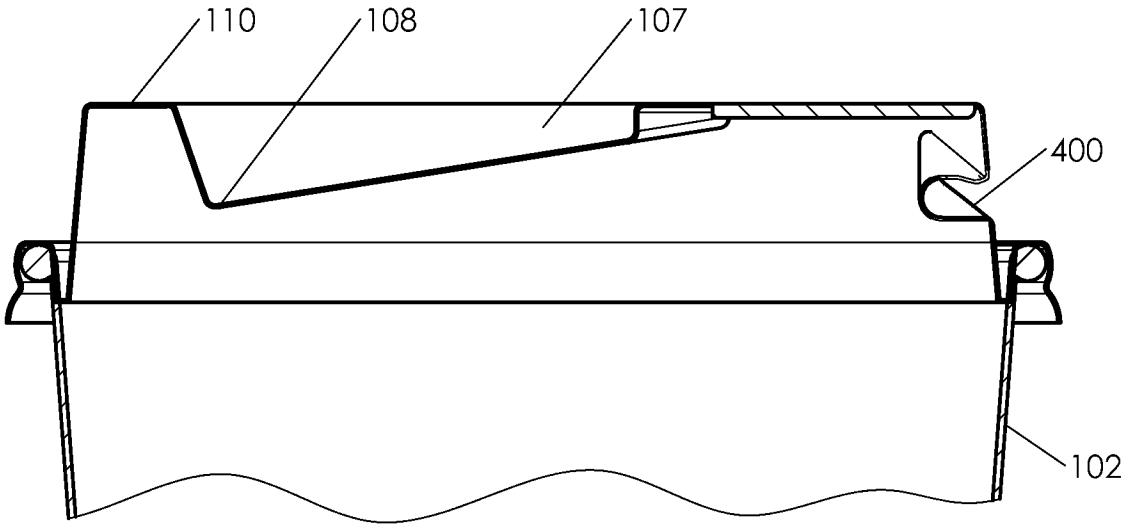
FIG. 4*b* depicts a top view of a third alternate embodiment of the invention showing the improved container lid removably attached to a container in a closed position.
Figure 4C:
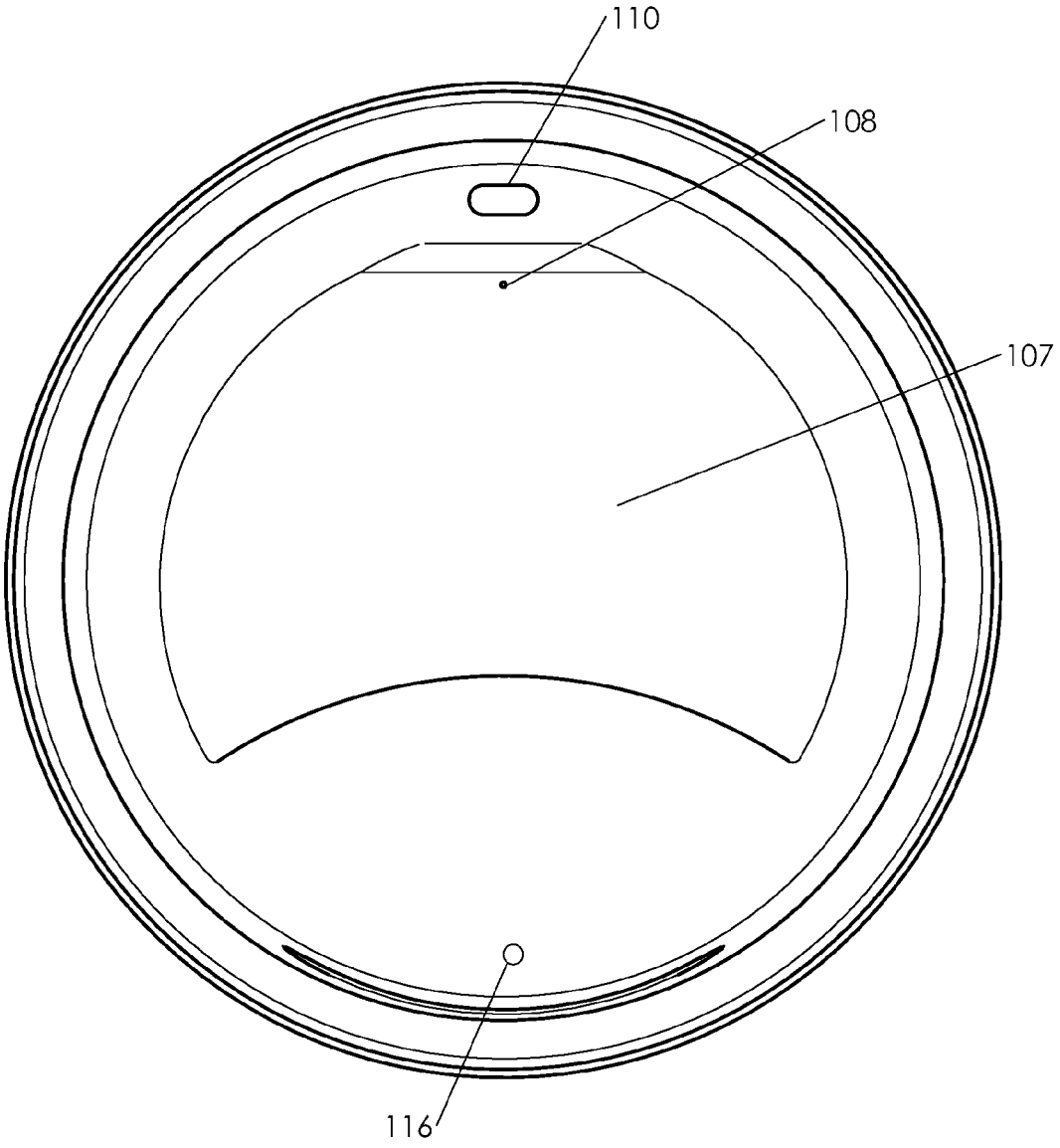
FIG. 4*c* depicts a top view of a third alternate embodiment of the invention.

Referring now to FIGS. 4*a*, 4*b* and 4*c*, a third alternate embodiment container lid 401 is depicted in which lid retaining channel 400 is formed in annular side wall 112. Lid retaining channel 400 comprises an upper wall 402, a lower wall 403 and a back wall 404 which together form a contiguous surface with annular side wall 112 and lid top surface 115 such as to form, except for aperture 110, drain hole 108 and vent hole 116, a contiguous surface for third alternate embodiment container lid 401 such that a flowable substance is substantially prevented from spilling out of the container when third alternate embodiment container lid 401 is installed in a closed position. In this alternate embodiment, channel 400 is configured to accept the container rim 101 in a press fit such that third alternate embodiment container lid 401 may be removably attached to container 102.

Still referring to FIGS. 4*a*, 4*b* and 4*c*, third alternate embodiment container lid 401 may further comprise well 107 which may have a sloping bottom surface, well drain hole 108. These optional features allow flowable substance to be captured in well 107 and to drain into container 102 through well drain hole 108 which may be disposed at substantially the lowest point of the sloping bottom surface of well 107. Such collection of flowable substance may occur, for example, when third alternate embodiment container lid 401 is installed in a closed position on a container containing a beverage. In this example, a user may drink from the container through aperture 110, leaving a small amount of liquid that is not consumed by the user, and which drains into well 107, whereupon it may drain back into container 102 through well drain hole 108 thus preventing unnecessary drippings from collecting on lid top surface 115. Well 107, well drain hole 108, aperture 110 and vent hole 116 are optional elements and need not be present in all embodiments of the invention. Thus, the third alternate embodiment container lid 401 of the invention may include any of these or none of these these elements in the various alternate embodiments. Still referring to FIGS. 4*a*, 4*b* and 4*c*, optional vent hole 116 allows air to enter container 102 in the event that container 102 is tipped to allow flowable liquid to exit the container through aperture 110. In the third alternate embodiment container lid 401 shown in FIG. 4*a*, lid top surface 115 is substantially planar, although in further alternate embodiments lid top surface 115 need not be planar but may be any shape desired.

Figure 5A:
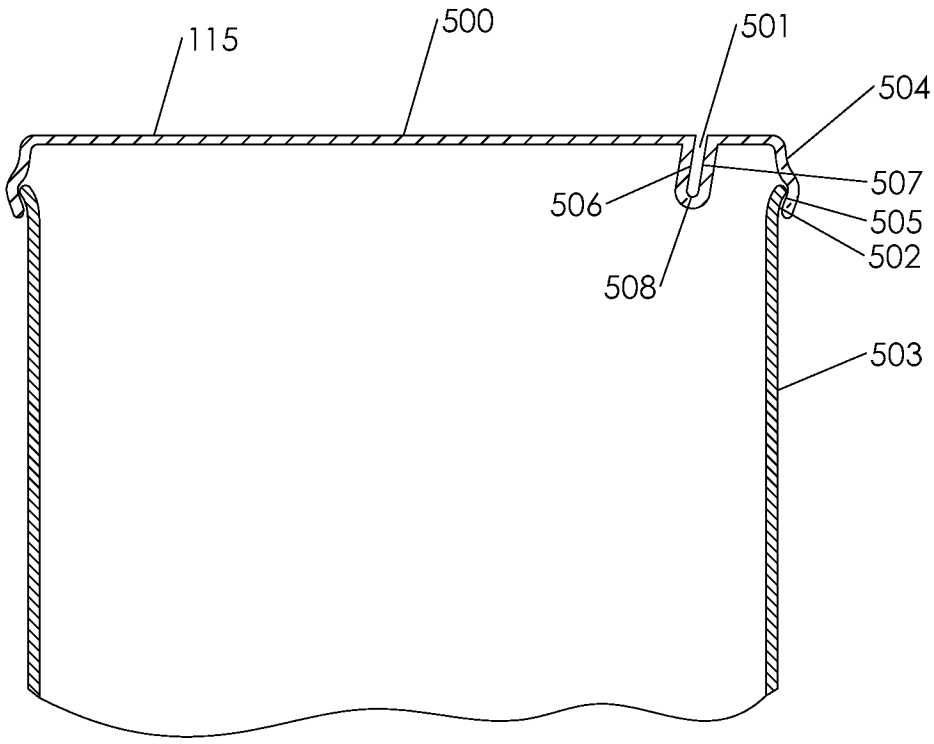
FIG. 5*a* depicts a cross section side view of a fourth alternate embodiment of the invention with the container lid of the invention removably attached to a container in a closed position.
Figure 5B:
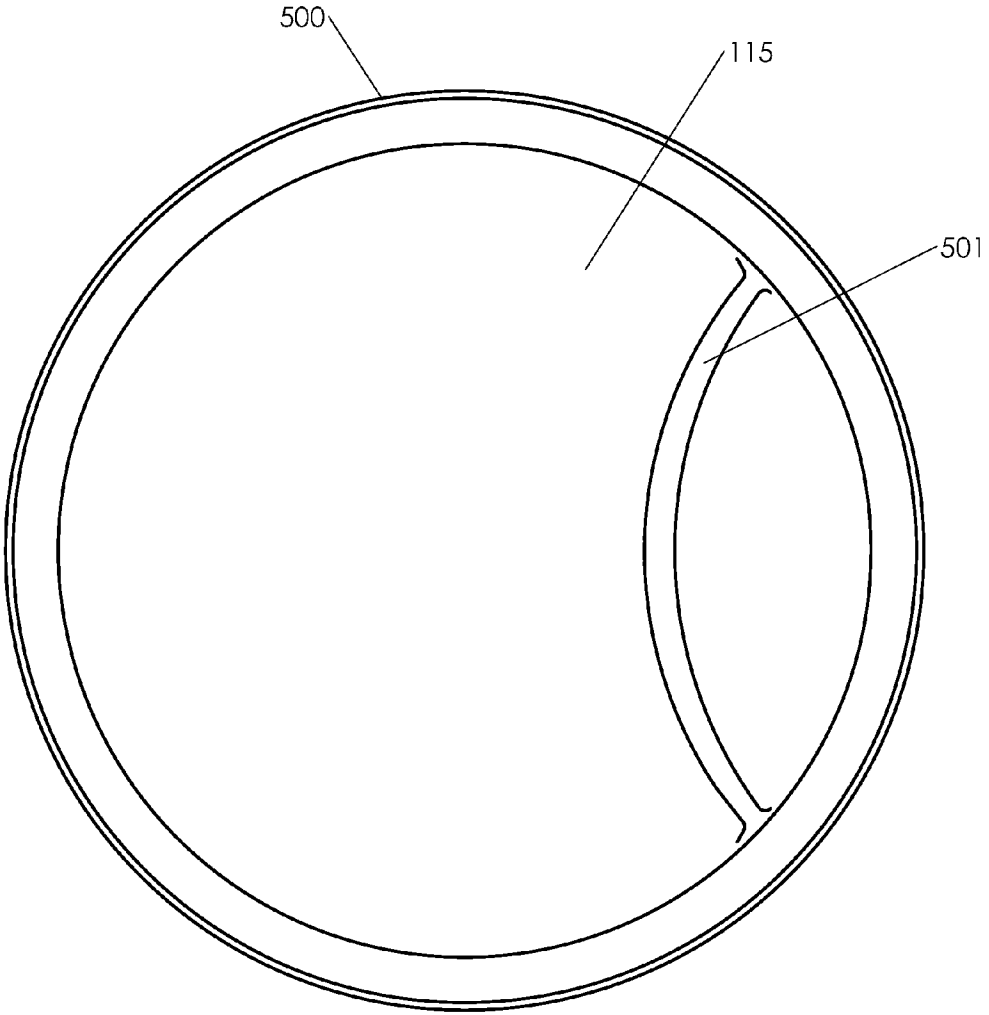
FIG. 5*b* depicts a top view of a fourth alternate embodiment of the invention adapted to removably attach to a circular container.
Figure 5C:
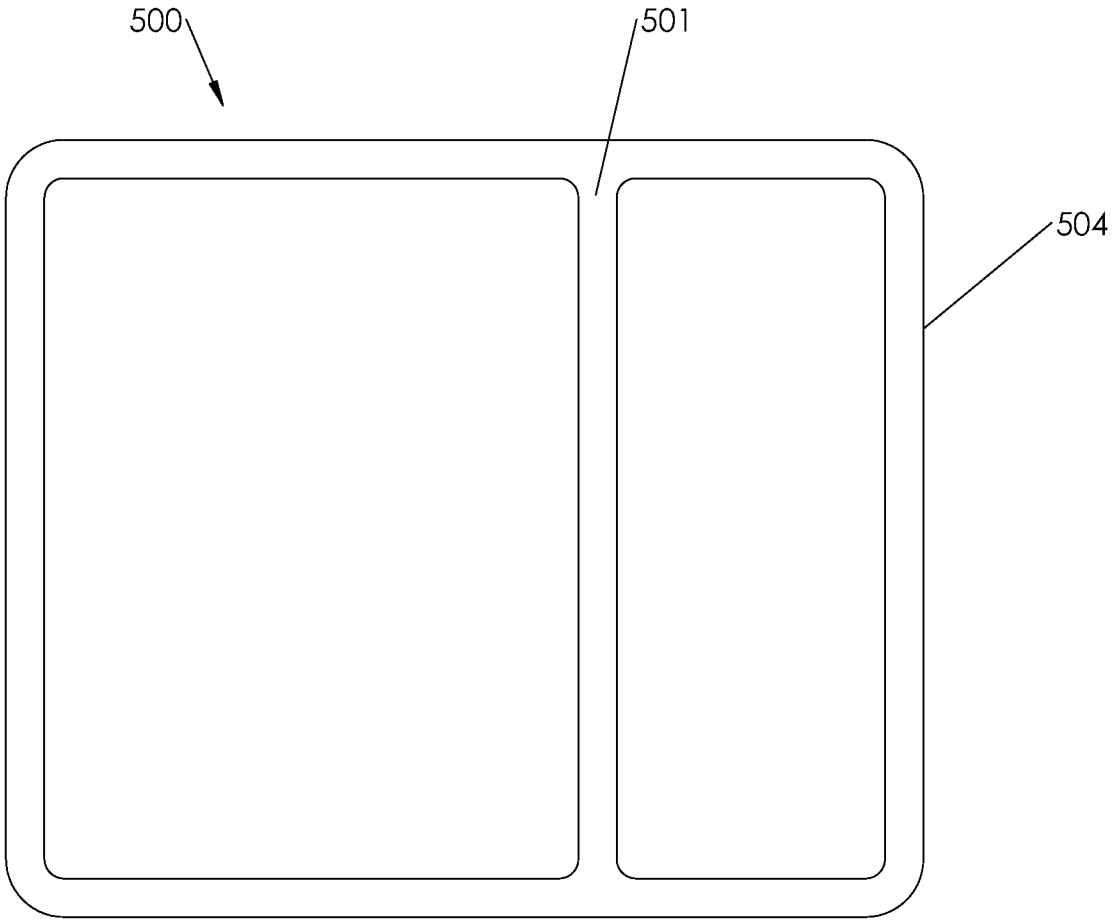
FIG. 5*c* depicts a top view of a fourth alternate embodiment of the invention adapted to removably attach to a square container.
Figure 5D:
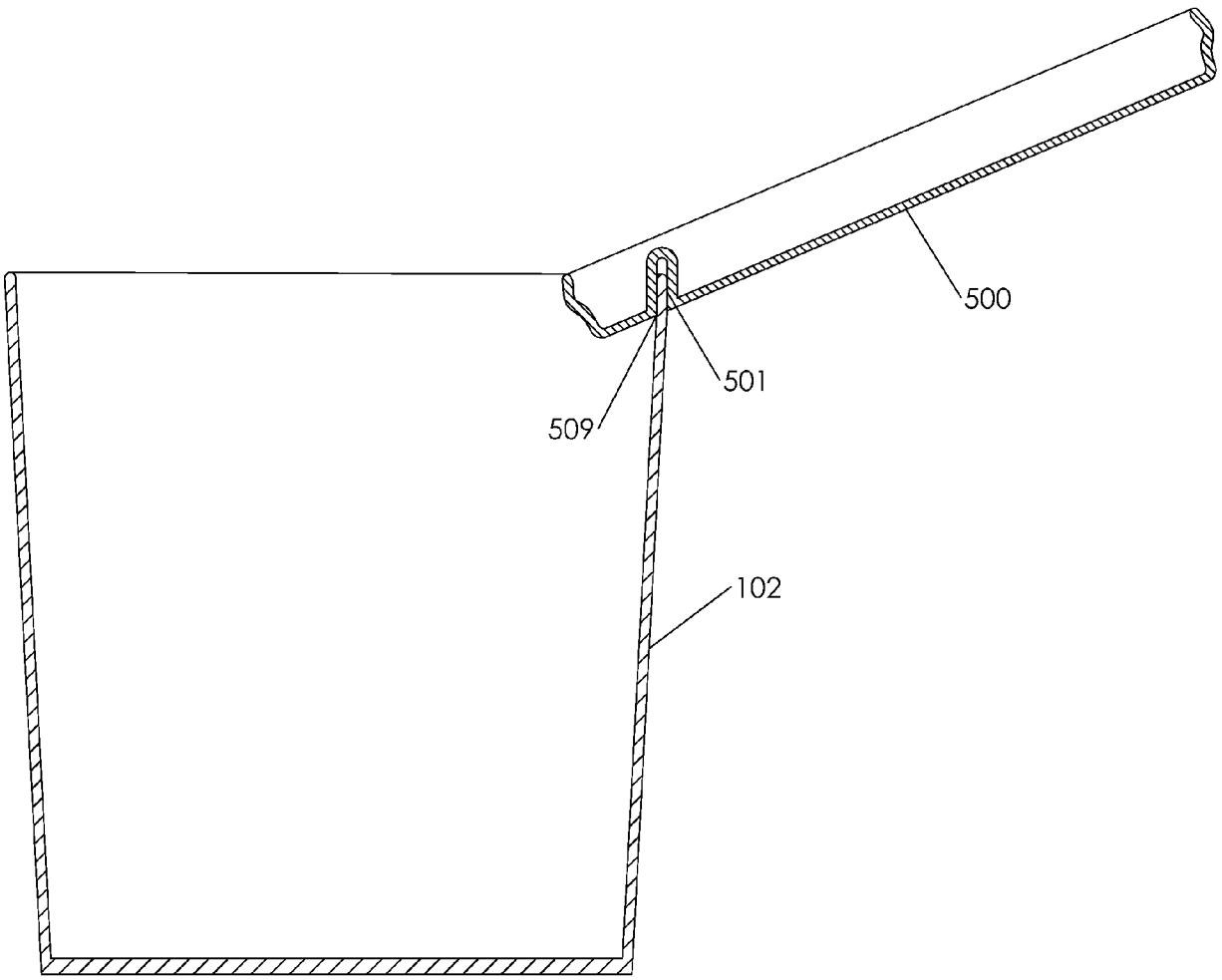
FIG. 5*d* depicts a cross section side view of a fourth alternate embodiment of the invention with the container lid of the invention removably attached to a container in an open position.

Referring now to FIGS. 5*a*, 5*b* 5*c* and 5*d*, a fourth alternate embodiment container lid 500 is shown. FIG. 5*a* depicts the fourth alternate embodiment of the invention in a cross section side view, in which fourth alternate embodiment container lid 500 is removably attached to container 503 at interface 502. The removable attachment means at interface 502 may be a press fit between the inner surface 505 of container lid side wall 504 and container 503 outer surface; or, the removable attachment means may be a threaded engagement between the inner surface 505 of container lid side wall 504 and container 503 outer surface, in which the inner surface 505 of container lid side wall 504 comprises threads adapted to receive matching threads formed on container 503 outer surface such that fourth alternate embodiment container lid 500 may be threadingly engaged with container 503 at interface 502. Fourth alternate embodiment container lid 500 further comprises lid retaining channel 501 that comprises a first side wall 506, a second side wall 507 and a bottom 508 which together form a contiguous surface with container lid side wall 504 and lid top surface 115 such as to form a contiguous surface for fourth alternate embodiment container lid 500 such that a flowable substance is substantially prevented from spilling out of the container when fourth alternate embodiment container lid 500 is installed in a closed position as depicted in FIG. 5*a*. FIG. 5*b* depicts a top view of the fourth alternate embodiment container lid 500 of the invention. In this view, fourth alternate embodiment container lid 500 is shown as circular in its outer shape such that it would be adapted to removably attach in a closed position with a circular-shaped container. However, it is to be understood that fourth alternate embodiment container lid 500 may take any outer shape including elliptical, rectangular, square or any other shape known in the container art, and thus may be removably attached to such shaped containers. Thus, the fourth alternate embodiment container lid 500 of the invention is not constrained to have only a circular shape as viewed from the top, but may be any shape that is adapted to removably attach to a container of any given shape. Lid retaining channel 501 may be recessed into lid top surface 115 so as to receive container rim 509 of container 503 as shown in FIG. 5*d*, by a press fit formed between lid retaining channel 501 and container rim 509. In the exemplary fourth alternate embodiment container lid 500 depicted in FIG. 5*b*, lid retaining channel 501 is arcurate in shape as viewed from the top and is adapted to receive an arcurate container rim 509, as would be the case, for example, if container 503 were circular in cross section. FIG. 5*c* shows another exemplary embodiment of the fourth alternate embodiment of container lid 500 which is adapted to removably attach in a closed position and an open position on a substantially square container 503. In FIG. 5*c*, lid retaining channel 501 is linear in shape as viewed from the top and is adapted to receive a linear container rim 509, as would be the case, for example, if container 503 were square or rectangular in cross section.

Figure 6:
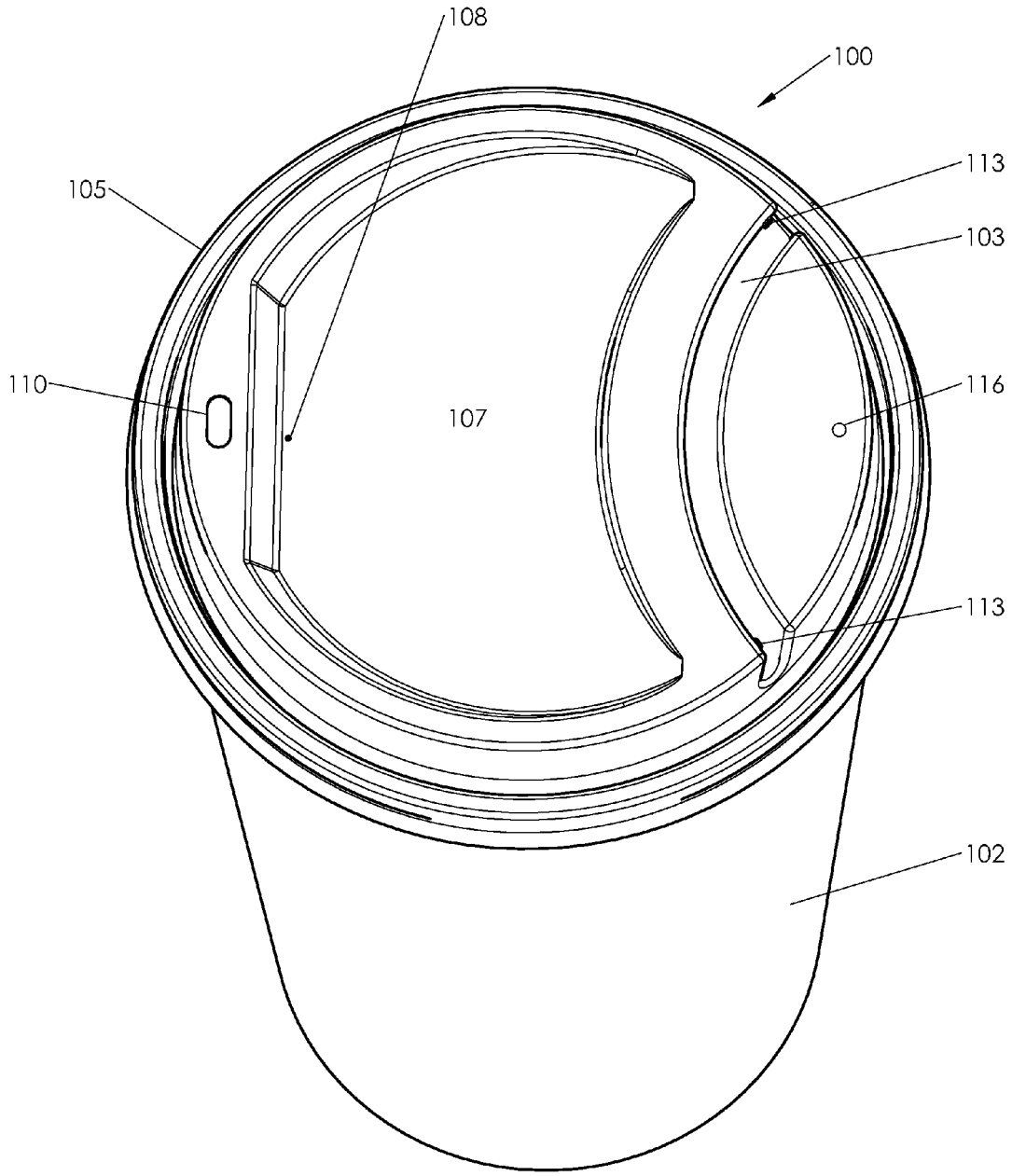
FIG. 6 depicts a perspective view of a preferred embodiment of the invention showing the improved container lid removably attached to a container in a closed position.

Referring now to FIG. 6, a perspective view of a preferred embodiment of the improved container lid 100 is depicted as removably attached to a container 102 in a closed position. Aperture 110, well 107, drain hole 108, vent hole 116, and lid retaining channel 103 are shown in their relative positions in this preferred embodiment.

Figure 7:
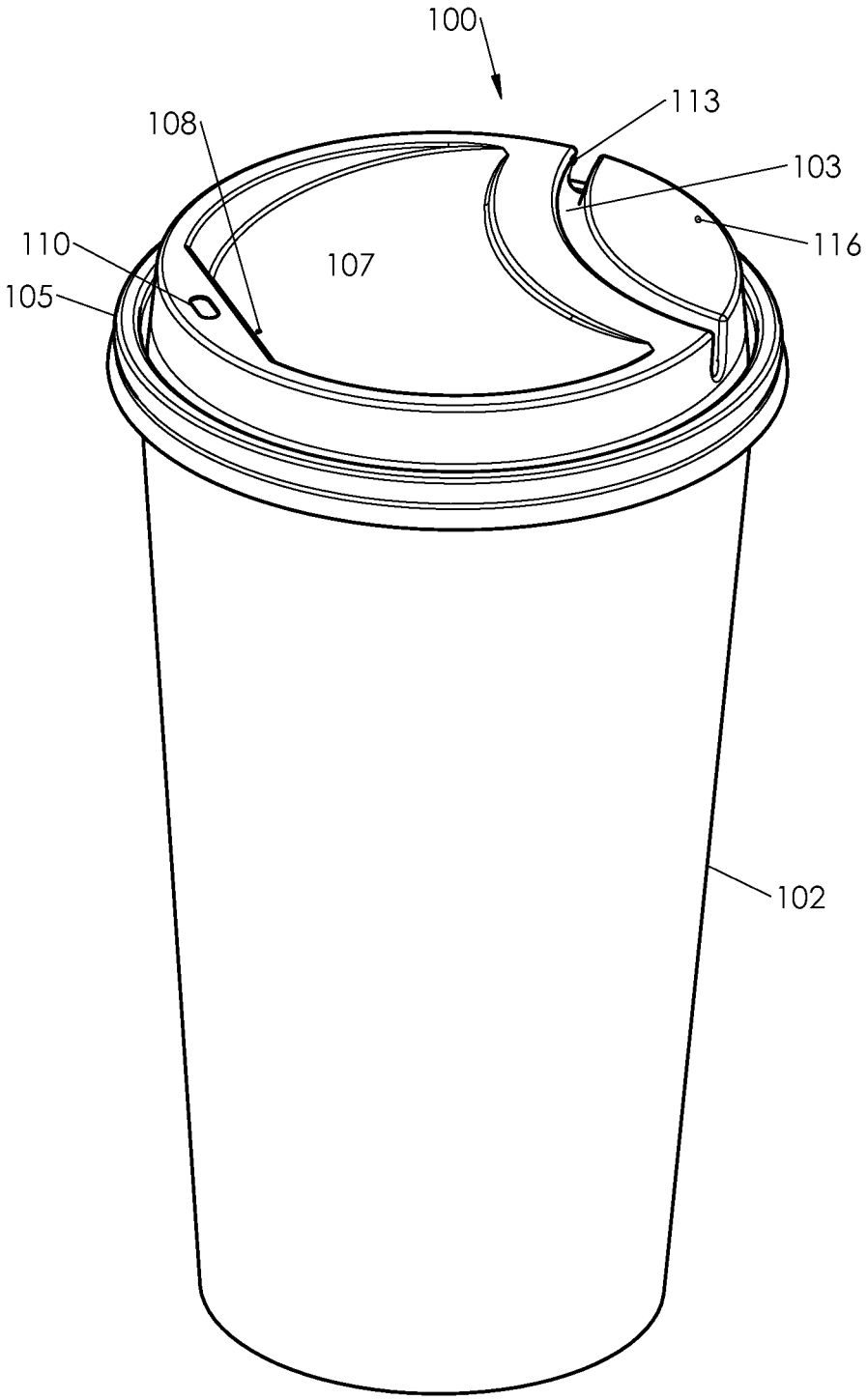
FIG. 7 depicts a perspective view of a preferred embodiment of the invention showing the improved container lid removably attached to a container in a closed position.

Referring now to FIG. 7, a further perspective view of a preferred embodiment of the improved container lid 100 is depicted as removably attached to a container 102 in a closed position. Aperture 110, well 107, drain hole 108, vent hole 116, and lid retaining channel 103 are shown in their relative positions in this preferred embodiment.

Figure 8:
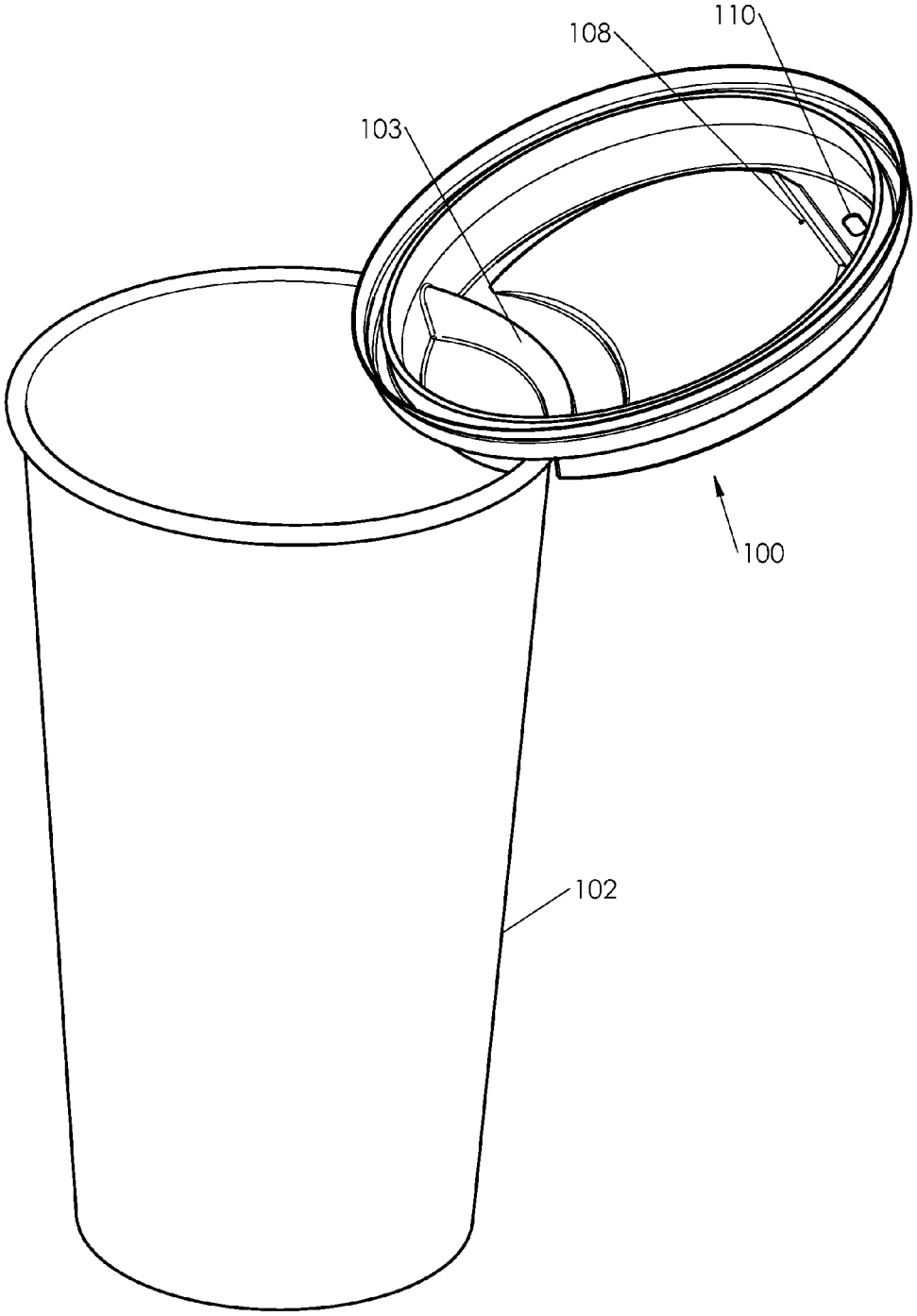
FIG. 8 depicts a perspective view of a preferred embodiment of the invention showing the improved container lid removably attached to a container in a closed position.

Referring now to FIG. 8, a perspective view of a preferred embodiment of the improved container lid 100 is depicted as removably attached to a container 102 in an open position. Drain hole 108, lid retaining channel 103 are shown in their relative positions in this preferred embodiment.

Figure 9:
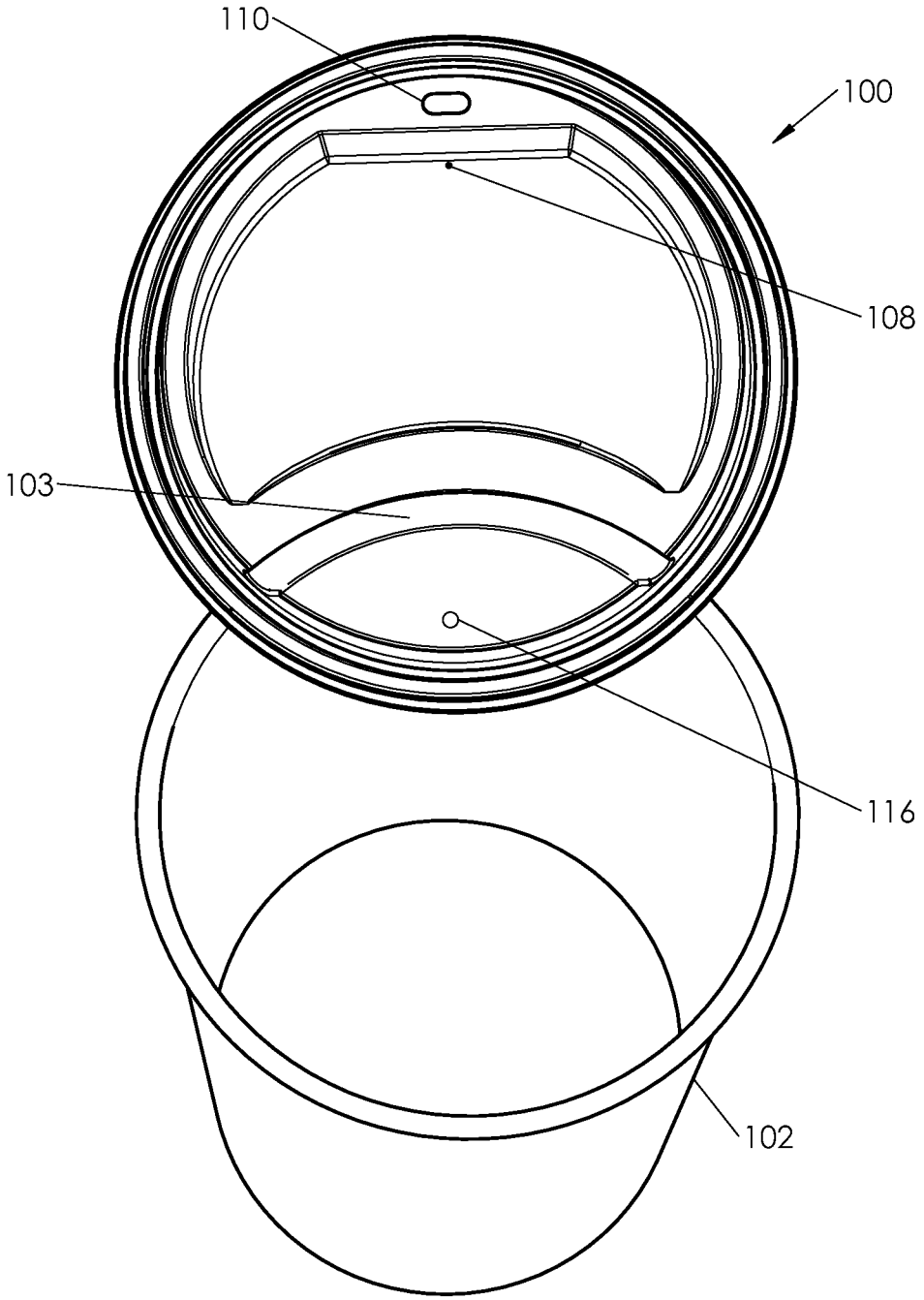
FIG. 9 depicts a perspective view of a preferred embodiment of the invention showing the improved container lid removably attached to a container in a closed position.

Referring now to FIG. 9, a further perspective view of a preferred embodiment of the improved container lid 100 is depicted as removably attached to a container 102 in an open position. Drain hole 108, vent hole 116 and lid retaining channel 103 are shown in their relative positions in this preferred embodiment.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

What is claimed is:

1. A lid adapted for removable attachment to a container having a rim, said lid comprising:

a top contiguous surface forming a plateau and having a periphery, an annular side wall contiguous to said periphery of said top surface and extending substantially downward from said top surface, wherein said annular sidewall is adapted to removably attach in a closed position to said container having a rim, and a first arcuate protuberance and a second arcuate protuberance extending from said plateau, wherein said first arcuate protuberance and said second arcuate protuberance are disposed so as to form an arcuate lid retaining channel between them, said lid retaining channel having a first side wall formed by a portion of said first protuberance, a second side wall formed by a portion of said second protuberance and a bottom wall connecting said first side wall and said second side wall such that said first side wall, second side wall and bottom wall form a contiguous surface, said lid retaining channel able to receive said container rim in a press fit;

wherein said top surface further comprises an aperture formed therethrough, through which a flowable substance held by said container may be dispensed when said lid is attached to said container in a closed position; and such that, when said lid is removed from said closed position and placed on a container having a rim by pressing said channel onto said container rim, said lid is removably attached to said container rim.

2. The lid of claim 1, wherein said periphery is substantially circular in shape, and wherein said annular side wall is adapted to removably attach in a closed position to said container having a rim that is substantially circular, and wherein said lid retaining channel is arcuate in shape, and wherein said arcuate shape of said lid retaining channel is adapted to removably attach to said substantially circular rim of said container.

3. The lid of claim 1, further comprising a well disposed in said lid top contiguous surface.

4. The lid of claim 3, wherein said well comprises a sloping bottom surface, and further comprises a through hole disposed in said well sloping bottom surface at substantially the lowest point of said sloping bottom surface, such that liquid present in said well passes through said hole and into said container when said lid is removably attached to a container in a closed position.

5. The lid of claim 4, further comprising a vent hole in said top surface, through which air may flow when said top is removably attached to said container in a closed position and a flowable substance is being poured through said aperture.

6. The lid of claim 1, further defined as being fabricated from a recyclable material.

7. The lid of claim 1, wherein said first side wall or said second side wall further comprise at least one retaining channel protrusion adapted to provide a point press fit with said container rim when said lid is installed on said container rim.

8. A lid adapted for removable attachment to a container having a rim, said lid comprising:

a generally circular top contiguous surface forming a plateau and having a periphery, an annular side wall contiguous to the periphery of said top surface and extending substantially downward from said top surface, wherein said annular wall is adapted to removably attach in a closed position to said container having a rim, at least one mound disposed in said top extending from and forming a raised area in said plateau, and wherein said mound comprises at least one arcuate lid retaining channel passing through said mound, said arcuate lid retaining channel having a first side wall, a second side wall and a bottom wall such that said first side wall, second side wall and bottom wall form a contiguous surface with said top surface, said lid retaining channel able to receive said container rim in a press fit;

such that, when said lid is removed from said container and placed on said container having a circular rim by pressing said arcuate lid retaining channel onto said circular container rim, said lid is removably attached to said container rim in an open position;

wherein said top surface further comprises an aperture formed therethrough, through which a flowable substance held by said container may be dispensed when said lid is attached to said container in a closed position; and wherein said well comprises a sloping bottom surface, and further comprising a through hole disposed in said well sloping bottom surface at substantially the lowest point of said sloping bottom surface, such that liquid present in said well passes through said lid and into said container when said lid is removably attached to a container in closed position.

9. The lid of claim 8, further comprising a vent hole in said top surface, through which air may flow when said top is removably attached to said container in a closed position and a flowable substance is being poured through said aperture.

10. A lid adapted for removable attachment to a container having a rim, said lid comprising:

a generally circular top contiguous surface forming a plateau defined by a plane, and having a periphery, an annular side wall contiguous to the periphery of said top surface and extending substantially downward from said top surface, wherein said annular side wall is adapted to removably attach in a closed position to said container having a rim, and an arcuate lid retaining channel disposed in said annular side wall, said arcuate lid retaining channel comprising an arc defined by a plane, wherein said arc plane is perpendicular to said plateau plane, and wherein said arcuate lid retaining channel has a top side wall, a bottom side wall and a back wall such that said top side wall, bottom side wall and back walls form a contiguous surface with said top surface and said annular side wall, and wherein said arcuate lid retaining channel does not protrude through said top surface, and wherein said lid retaining channel is able to receive said container rim in a press fit;

such that, when said lid is removed from said container and placed on said container having a circular rim by pressing said channel onto said circular container rim, said lid is removably attached to said container rim in an open position; and wherein said top surface further comprises an aperture formed therethrough, through which a flowable substance held by said container may be dispensed when said lid is attached to said container in a closed position.

11. The lid of claim 10, further comprising a well disposed in said lid top contiguous surface.

12. The lid of claim 11, wherein said well comprises a sloping bottom surface, and further comprising a through hole disposed in said well sloping bottom surface at substantially the lowest point of said sloping bottom surface, such that liquid present in said well passes through said lid and into said container when said lid is removably attached to a container in closed position.

13. The lid of claim 12, further comprising a vent hole in said top surface, through which air may flow when said top is removably attached to said container in a closed position and a flowable substance is being poured through said aperture.

14. The lid of claim 10, further defined as being fabricated from a recyclable material.

15. A lid adapted for removable attachment to a container having a rim, said lid comprising:

a generally circular top contiguous surface forming a plateau and having a periphery, an annular side wall contiguous to the periphery of said top surface and extending substantially downward from said top surface, wherein said annular wall is adapted to removably attach in a closed position to said container having a rim, at least one mound disposed in said top extending from and forming a raised area in said plateau, and wherein said mound comprises at least one arcuate lid retaining channel passing through said mound, said arcuate lid retaining channel having a first side wall, a second side wall and a bottom wall such that said first side wall, second side wall and bottom wall form a contiguous surface with said top surface, said lid retaining channel able to receive said container rim in a press fit;

such that, when said lid is removed from said container and placed on said container having a circular rim by pressing said arcuate lid retaining channel onto said circular container rim, said lid is removably attached to said container rim in an open position;

wherein said top surface further comprises an aperture formed therethrough, through which a flowable substance held by said container may he dispensed when said lid is attached to said container in a closed position; and wherein said first side wall or said second side wall further comprise at least one retaining channel protrusion adapted to provide a point press fit with said container rim when said lid is installed on said container rim.

* * * * *